United States Patent [19]

Speir et al.

[11] Patent Number: 4,464,330

[45] Date of Patent: Aug. 7, 1984

[54] APPARATUS FOR IRRADIATING A CONTINUOUSLY FLOWING STREAM OF FLUID

[75] Inventors: Leslie G. Speir, Espanola; Edwin L. Adams, Jemez Springs, both of N. Mex.

[73] Assignee: The United States of America as represented by the Department of Energy, Washington, D.C.

[21] Appl. No.: 377,898

[22] Filed: May 13, 1982

[51] Int. Cl.[3] ..... G21G 1/06

[52] U.S. Cl. ..... 376/159; 376/340; 376/904; 250/308; 250/432 R; 250/435; 250/437

[58] Field of Search ..... 376/159–167, 376/340, 344, 345, 904; 250/432 R, 435, 437, 308

[56] References Cited

U.S. PATENT DOCUMENTS

| | | | |
|---|---|---|---|
| 3,042,599 | 7/1962 | Biehl | 376/904 X |
| 3,527,940 | 9/1970 | Balanca et al. | 250/437 X |
| 3,683,183 | 8/1972 | Vizzini et al. | 250/437 X |
| 4,020,352 | 4/1977 | Mahler et al. | 250/437 X |
| 4,024,393 | 5/1977 | Braun et al. | 376/159 |
| 4,263,098 | 4/1981 | Kasperek et al. | 376/159 |
| 4,266,132 | 5/1981 | Marshall | 250/390 X |
| 4,278,885 | 7/1981 | von Alfthan et al. | 376/159 X |
| 4,282,433 | 8/1981 | Löffel | 250/435 X |
| 4,361,534 | 11/1982 | Borsaru et al. | 376/159 |

*Primary Examiner*—Peter A. Nelson

*Attorney, Agent, or Firm*—William A. Eklund; Paul D. Gaetjens; Michael F. Esposito

[57] ABSTRACT

An apparatus for irradiating a continuously flowing stream of fluid is disclosed. The apparatus consists of a housing having a spherical cavity and a spherical moderator containing a radiation source positioned within the spherical cavity. The spherical moderator is of lesser diameter than the spherical cavity so as to define a spherical annular volume around the moderator. The housing includes fluid intake and output conduits which open onto the spherical cavity at diametrically opposite positions. Fluid flows through the cavity around the spherical moderator and is uniformly irradiated due to the $4\pi$ radiation geometry. The irradiation source, for example a $^{252}$CF neutron source, is removable from the spherical moderator through a radial bore which extends outwardly to an opening on the outside of the housing. The radiation source may be routinely removed without interrupting the flow of fluid or breaching the containment of the fluid.

4 Claims, 3 Drawing Figures

APPARATUS FOR IRRADIATING A CONTINUOUSLY FLOWING STREAM OF FLUID

BACKGROUND OF THE INVENTION

The invention disclosed herein is generally related to the method of elemental chemical analysis known as neutron activation. More particularly, this invention is related to methods and apparatus for irradiating a flowing fluid with neutrons. This invention is the result of a contract with the Department of Energy (Contract No. W-7405-ENG-36).

Briefly, in neutron activation analysis a sample to be analyzed for its elemental composition is irradiated with neutrons to produce various radioactive activation products. The particular species of activation products produced are uniquely determined by the elemental composition of the sample. The subsequent decay of the activation products is accompanied by emission of characteristic gamma rays, neutrons and other types of radiation, which is analyzed by spectrophotometric techniques to determine the identities and concentrations of the activation products. From this information, the elemental composition of the sample can be determined.

In one application of this method, fissile materials in a sample are assayed by irradiating the sample with thermal neutrons to induce fission of the fissile materials. The fission is accompanied by prompt as well as delayed emission of neutrons and gamma radiation. These radiations are analyzed to determine the content of fissile materials in the sample.

Neutron irradiation of a sample may be accomplished in several ways. Most commonly, a sample aliquot is placed in a region of high neutron flux in a nuclear reactor. Alternatively, a sample may be irradiated by exposing it to a radioactive neutron source such as Californium-252 ($^{252}Cf$). The present invention is directed to the latter type of irradiation.

There has existed a need for a simple and efficient method of irradiating a continuously flowing stream of solution, for example solutions flowing in a chemical processing plant. Such irradiation could be coupled with downstream detection of delayed radiation (gamma rays or neutrons) by an appropriate detector so as to provide continuous, real-time analysis of the solution. Such a method of neutron activation analysis would have several advantages over the conventional method of removing a sample aliquot for analysis. First, the elemental composition of the flowing solution could be monitored in real-time, thus eliminating the usual delay between the taking of an aliquot and the analysis of its composition. Also, variations in the elemental composition with time could be detected and accurately measured. Further, all of the material in a process stream would be analyzed, as opposed to analysis of selected aliquots of the process stream such as is obtained by conventional neutron activation methods. Appropriate integration of temporal variations in a process stream would enable accurate material accounting of the various elements in the stream. Finally, continuous real-time monitoring of the elemental composition in a process stream could provide a basis for feedback-controlled regulation of the chemical process or processes being carried out upstream.

There are several factors to be considered with regard to the irradiation of a process stream with a neutron source such as $^{252}Cf$. First, it is desirable that the neutron source be in close proximity to the flowing stream so as to obtain optimum utilization of the source. Also, it is desirable that the neutron source be positioned within the process stream so as to uniformly irradiate all parts of the process stream, and also to make the most efficient use of the source, which emits neutrons in all directions uniformly. At the same time, however, it is desirable to be able to remove the neutron source from the process stream, for example to service or replace the source, without interrupting the flow of the stream or breaching the containment of the stream.

Accordingly, it is the object and purpose of the present invention to provide an apparatus for irradiating a fluid flowing in a process stream. More particularly, it is an object to provide an apparatus for neutron irradiation of flowing fluid.

It is also an object of the invention to provide such an apparatus wherein the radiation source is removable from the process stream without interrupting the flow of the stream or breaching the primary containment of the flow path.

It is another object of the present invention to provide an apparatus for irradiating a process stream wherein the radiation source is positioned so as to obtain optimum geometrical efficiency of irradiation.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the irradiation apparatus of the present invention comprises a housing having a substantially spherical interior cavity and a pair of fluid inlet and outlet conduits opening into diametrically opposite points on the cavity. Inside the cavity there is positioned a substantially spherical central moderator which is adapted to contain a radiation source. The diameter of the moderator is less than the diameter of the cavity so as to define a spherical annular volume between the housing and the moderator through which a fluid may be passed. The moderator is supported and centrally positioned within the cavity by at least one radially extending support member which is connected to the housing. The support member includes a central bore which extends radially to the center of the moderator and which opens outwardly from the housing so as to permit insertion of a radiation source into the center of the moderator from outside the housing without interrupting the flow of fluid through the housing or breaching the containment of the fluid.

The advantage of placing a radiation source at the center of the spherical moderator is that the optimum $4\pi$ irradiation geometry can be obtained. Such a geometry makes the most efficient use of the radiation source because virtually all of the radiation emitted by the source impinges on fluid flowing around the moderator. At the same time, this geometry results in uniform irradiation of the various portions of the fluid stream passing around the moderator at different meridional angles. Moreover, if the difference between the diameters of the spherical cavity and the spherical moderator is small compared with the radius of the moderator, the spherical annular volume through which the fluid passes is relatively thin in radial directions, and thus takes the form of a spherical shell. This results in substantially uniform irradiation of the fluid in radial directions, such that all increments of fluid passing through the housing receive approximately equal doses of radiation.

In the preferred embodiment, the moderator is made of a neutron moderating material such as high density polyethylene. In this an embodiment the moderator serves two functions; namely, to moderate the high energy fission neutrons from a source such as $^{252}Cf$, and also to space the source radially inwardly from the fluid so as to result in a thin-shelled spherical annular volume in which all increments of the fluid are irradiated uniformly, as noted above. Preferably, the housing is also formed of high density polyethylene or some other neutron moderating material that acts as a neutron reflector and thereby makes even more efficient use of the neutron source.

Although the irradiation apparatus of the present invention is primarily designed for neutron irradiation, it will be recognized that the $4\pi$ irradiation geometry and the removability of the radiation source are advantageous features which may render the apparatus useful in other applications. For example, a radioactive source of gamma radiation could be utilized to sterilize a flowing process solution. Accordingly, the scope of the invention is considered to include such applications.

These and other aspects of the invention will become more apparent upon reading the following detailed description of the preferred embodiment, taken with the accompanying drawings.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE PREFERRED EMBODIMENT

Figure 1:
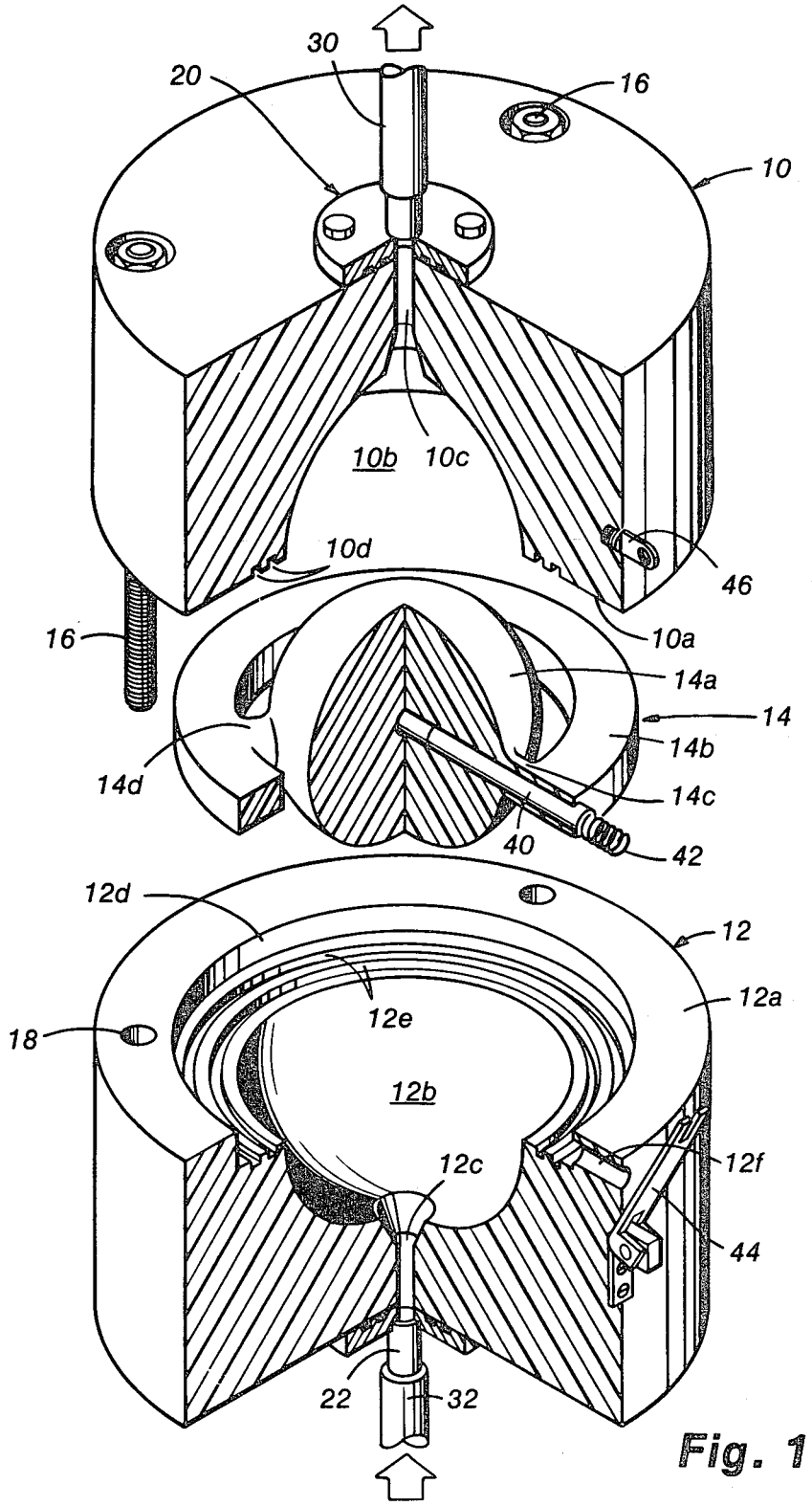
FIG. 1 is an exploded isometric view of the preferred embodiment of the irradiation apparatus of the present invention.
Figure 2:
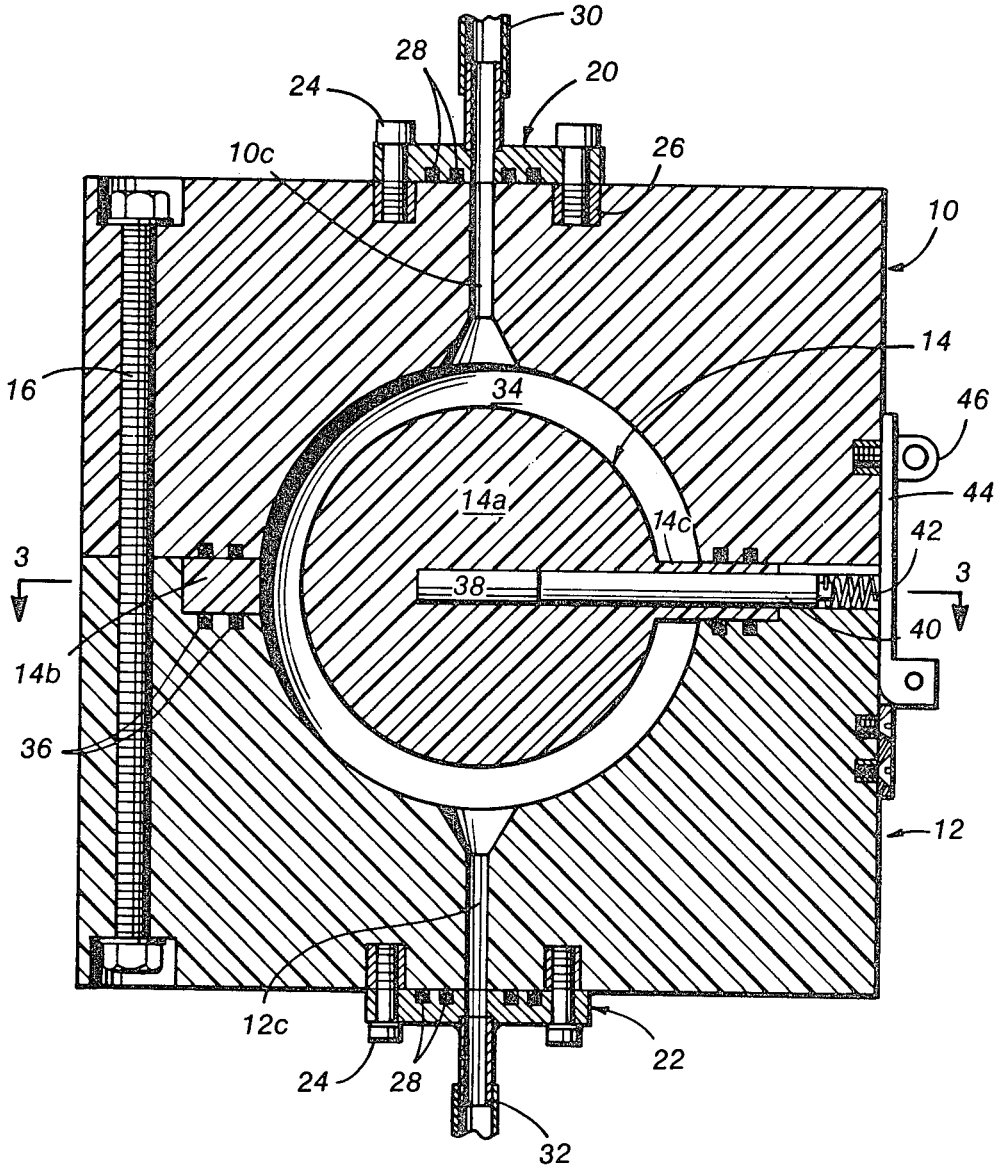
FIG. 2 is a side elevation view in cross-section of the embodiment shown in FIG. 1.
Figure 3:
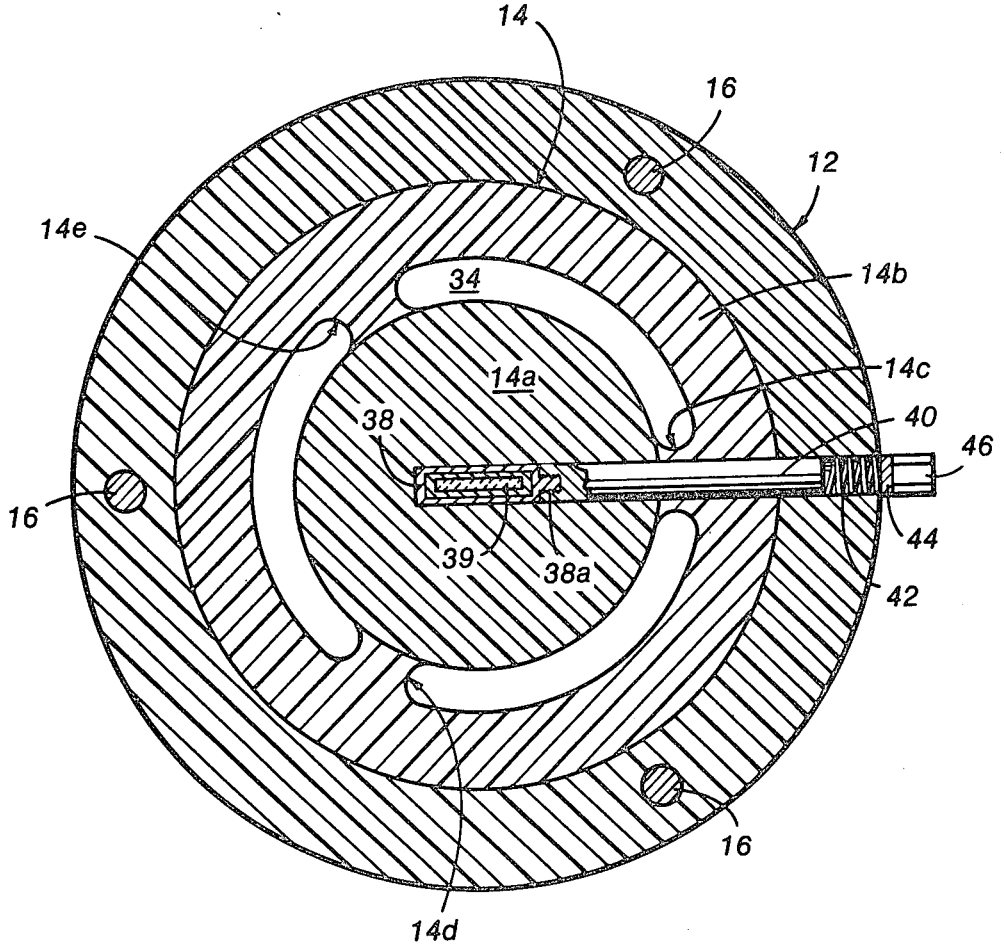
FIG. 3 is a plan view in cross-section of the embodiment shown in FIG. 1, taken along section lines 3—3 of FIG. 2.

Referring to FIGS. 1 through 3, the preferred embodiment of the irradiation apparatus of the present invention includes an upper housing block 10, a lower housing block 12, and a central moderator 14, each of which is formed from a solid mass of high density polyethylene.

The upper and lower housing blocks 10 and 12 are generally cylindrical and include mutually opposing planar end faces 10*a* and 12*a*. Opening onto the end faces 10*a* and 12*a* are concave hemispherical cavities 10*b* and 12*b*, respectively, which together form a spherical interior cavity when the two housing blocks 10 and 12 are clamped together. The housing blocks 10 and 12 are clamped together by a set of three through bolts 16 which pass through axial bores 18 in the peripheries of the housing blocks 10 and 12.

The upper housing block 10 includes a fluid outlet bore 10*c* which opens into the top center of the hemispherical cavity 10*b*. Likewise, the lower housing block 12 includes a fluid inlet bore 12*c* which opens into the bottom of the hemispherical cavity 12*b*. Each of the bores 10*c* and 12*c* is flared where it opens into the respective hemispherical cavity.

At the opposite ends of the fluid outlet and inlet bores 10*c* and 12*c* are stainless steel tube fittings 20 and 22, respectively, which are fastened to the outer ends of the respective housing blocks 10 and 12 by means of machine screws 24. The machine screws 24 are threaded into metal inserts 26 to securely fasten the tube fittings 20 and 22 to the polyethylene housing blocks 10 and 12. Fluid-tight seals between the tube fittings 20 and 22 and the respective housing blocks 10 and 12 are provided by O-rings 28 which are set into concentric O-ring grooves formed in the end surfaces of the tube fittings 20 and 22. The tube fittings 20 and 22 are connected to process tubing 30 and 32, through which the solution to be analyzed flows.

The central moderator 14 consists of a spherical ball 14*a* positioned centrally inside an annular ring 14*b* by means of three integral radial spokes 14*c*, 14*d* and 14*e* (shown best in FIG. 3). The annular ring 14*b* is rectangular in cross-section and is spaced radially from the ball 14*a* by the three spokes 14*c*, 14*d* and 14*e*. With the apparatus assembled, the ring 14*b* is received in an annular recess 12*d* formed in the face 12*a* of the lower housing block 12 around the opening of the hemispherical cavity 12*b*. The inside diameter of the ring 14*b* is the same as the diameter of the spherical cavity formed by the two hemispherical cavities 10*b* and 12*b*, such that there is formed a spherical annular volume 34 (FIG. 2) around the ball 14*a*. During operation of the apparatus, a solution is pumped through the annular volume 34 and around the ball 14*a*. The spokes 14*c*, 14*d* and 14*e* are contoured to facilitate smooth flow of solution around them. A fluid-tight seal between the upper and lower housing blocks 10 and 12 is provided by a set of four O-rings 36, two each of which are engaged against the planar upper and lower surfaces of the ring 14*b*. In this regard, two of the O-rings 36 are set into a pair of concentric O-ring grooves 10*d* formed in the face of the upper housing block 10, and the other two O-rings 36 are set into concentric O-ring grooves 12*e* formed in the bottom surface of the annular recess 12*d* in which the ring 14*b* is received. With this arrangement, the O-rings 36 form fluid-tight seals upon the housing blocks 10 and 12 being bolted together.

The moderator 14 further includes a radial bore 14*f* which opens on the side of the annular ring 14*b* and which extends through the spoke 14*c* to a point slightly beyond the center of the ball 14*a*. Positioned at the interior end of the bore 14*f* at the center of the ball 14*a* is a cylindrical, stainless-steel, double-walled capsule 38, which contains approximately one microgram of a neutron source 39 consisting of $^{252}Cf$. This amount of $^{252}Cf$ decays by spontaneous fission to produce approximately $2\times10^7$ neutrons per second. The capsule 38 is a standard neutron source, known in the nuclear industry as a SR-CF-100 capsule. Since the half-life of $^{252}Cf$ is approximately 2.64 years, the capsule 38 must be periodically replaced to maintain a relatively constant neutron flux.

The capsule 38 is connected to a cylindrical rod 40 of high density polyethylene by a threaded tang 38*a*. The rod 40 serves to fill the unoccupied portion of the bore 14*f* with neutron-moderating polyethylene, and also functions as a handle with which the capsule 38 can be handled.

At the outer end of the rod 40 is a coil compression spring 42. The spring 42 is compressed by means of a hasp 44 which is hinged to the side of the lower housing block 12. In this regard, the hasp 44 swings over the opening of a radial bore 12*f* which passes through the wall of the lower housing block 12 and which is aligned with the bore 14*f* of the moderator. The hasp 44 is engageable with a padlock staple 46 affixed to the side of the upper housing block 10. In practice, the hasp 44 is padlocked shut to prevent inadvertent or wrongful removal of the radioactive $^{252}$Cf source, and also to maintain the source capsule 38 firmly maintained in its proper position at the center of the ball 14*a*.

In the illustrated preferred embodiment, the ball 14*a* of the moderator 14 has a diameter of approximately 4" and the spherical cavity has a diameter of approximately 5". This results in a spherical annular volume 34 approximately ½" thick through which all fluid passes. It is found that the 2-inch thickness of polyethylene, through which all neutrons must pass, results in adequate moderation of the high-energy fission neutrons emitted by the $^{252}$Cf source. This configuration also results in a relatively thin annular volume in which all fluid is irradiated substantially uniformly.

In operation, the irradiation apparatus may be inserted in any fluid flow stream. A gamma ray detector, for example a sodium iodide (NaI) or germanium lithium (GeLi) detector is placed downstream to detect delayed gamma radiation from activation products formed by neutron irradiation. Alternatively, delayed neutrons may be detected by a suitable detector to assay a flowing solution for fissile materials such as uranium or plutonium.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus for uniformly irradiating a flowing fluid, comprising:

a housing having a substantially spherical cavity, said housing consisting of two mutually opposing housing blocks each formed of a neutron moderating material, each of said blocks having a planar face and a semispherical concave cavity opening onto said planar face, means for clamping said blocks together with said planar faces opposing one another and with said semispherical cavities centered on and opposing one another so as to form said spherical cavity within said housing, said housing blocks having respective fluid flow inlet and outlet conduits which open onto said spherical cavity at diametrically opposite positions, a first one of said blocks including an annular recess in the planar face of said first block, said annular recess being centered on and surrounding the opening of the semispherical cavity in said first block; and a moderator including a spherical ball integrally connected to an encircling circular support ring by a plurality of support members, said support ring being sized and shaped to cooperably fit in said annular recess of said first housing block, and with said ball having a diameter smaller than the diameter of said spherical cavity of said housing, said support members extending radially outwardly from said ball to said support ring, with said ball, said support members and said support ring all being formed integrally of a neutron moderating material, whereby said moderator and said housing form an annular spherical volume between the ball of said moderator and said housing through which a fluid can be passed, said moderator including an internal bore extending radially from the center of said ball through one of said support members and through said support ring, and with said first housing block including a bore extending from said annular recess to the outside of said housing, said bore of said first housing block and said bore in said moderator being alignable so as to permit a radiation source to be inserted in and removed from the center of said ball of said moderator without interrupting the flow of a fluid passing through said annular spherical volume or breaching the containment of the fluid.

2. The apparatus defined in claim 1 wherein said neutron moderating material is high density polyethylene.

3. The apparatus defined in claim 1 wherein said radiation source is connected to a rod extending the major length of said bores, and wherein said source is maintained in the center of said spherical ball by means of a coil compression spring.

4. The apparatus defined in claim 3 wherein said neutron source is $^{252}$Cf.

* * * * *